US006648244B2

(12) United States Patent
Yu

(10) Patent No.: US 6,648,244 B2
(45) Date of Patent: Nov. 18, 2003

(54) ATOMIZER WITH A BELLOWS-SHAPED CONTAINER BODY

(76) Inventor: Lung-You Yu, No. 129, Wen-Chung Rd., Tao-Yuan City (TW)

( * ) Notice: Subject to any disclaimer, the term of this patent is extended or adjusted under 35 U.S.C. 154(b) by 65 days.

(21) Appl. No.: 10/025,720

(22) Filed: Dec. 18, 2001

(65) Prior Publication Data

US 2003/0111551 A1 Jun. 19, 2003

(51) Int. Cl.[7] ..... B05B 11/02

(52) U.S. Cl. ..... 239/323; 239/320; 239/333; 222/95; 222/386.5

(58) Field of Search ..... 239/320, 323, 239/333; 222/95, 107, 386.5

(56) References Cited

U.S. PATENT DOCUMENTS 3,421,662 A * 1/1969 Hanson ..... 239/323
4,062,475 A * 12/1977 Harris et al. ..... 222/95
6,062,437 A 5/2000 Mascitelli

FOREIGN PATENT DOCUMENTS

FR 89.921 9/1967

OTHER PUBLICATIONS

European Search Report dated May 21, 2002 corresponding to European Patent Application EP 01 31 0758.

* cited by examiner

*Primary Examiner*—Steven J. Ganey
(74) *Attorney, Agent, or Firm*—Christie, Parker & Hale, LLP

(57) ABSTRACT

An atomizer includes a flexible container body and a nozzle head unit. The container body includes a bellows-shaped surrounding wall, a bottom wall having an outer periphery that is formed integrally with a bottom end of the surrounding wall so as to define a closed bottom end of the container body, and a liquid-containing chamber defined within the surrounding wall and above the bottom wall and adapted to be filled with liquid. The nozzle head unit is attached to a top end of the surrounding wall, and can be operated so as to contract the container body, thereby discharging the liquid from the container body via the nozzle head unit.

6 Claims, 9 Drawing Sheets

ATOMIZER WITH A BELLOWS-SHAPED CONTAINER BODY

BACKGROUND OF THE INVENTION

1. Field of the Invention

This invention relates to an atomizer, such as a perfume container, and more particularly to an atomizer, which includes a bellows-shaped container body that can prevent undesired entry of air.

2. Description of the Related Art

Referring to FIG. 1, a conventional atomizer 1 is shown to include a container body 11, a nozzle head unit 12 that is mounted threadedly on to a top end of the container body 11 and that can be operated to discharge a liquid from the container body 11, a large piston 13 that is disposed movably within the container body 11, a bottom cover 14 for closing a bottom opening 111 in the container body 11, and a top cover 15 for covering a top end of the container body 11.

Referring to FIG. 2, the container body 11 has a liquid-containing chamber 110 that is defined above the large piston 13 and that is filled with the liquid, and an externally threaded upper end 112 that is threaded to the nozzle head unit 12. The nozzle head unit 12 includes a nozzle head 121, a vertical inner straw 122 that is attached to a lower end of the nozzle head 121, and a vertical outer straw 123 that is sleeved on the inner straw 122 and that receives the liquid within a lower portion thereof. A small piston 124 is disposed within the outer straw 123, and is sleeved movably on the inner straw 122. A coiled first compression spring 125 is also sleeved on the inner straw 122, and is disposed above the small piston 124 so as to bias the small piston 124 downward. A coiled second compression spring 126 is sleeved on the inner straw 122 so as to bias a ball 127 downward, thereby closing a bottom end opening of the outer straw 123. As such, the spring-loaded ball 127 serves as a check valve that limits liquid flow from the container body 11 into the nozzle head unit 12.

Referring to FIG. 3, when a force is applied to the nozzle head 121 in a downward direction, the inner straw 122 moves downward to compress the first and second compression springs 125, 126. The compressed first compression spring 125 presses against the ball 127, thereby closing the bottom end opening in the outer straw 123. The compressed second compression spring 126 moves the smaller piston 124 downward to press against a shoulder 1231 of the outer straw 123 so that the liquid is ejected from a chamber 1232 that is defined between the ball 127 and the small piston 124. The ejected liquid flows into the inner straw 12 via two aligned horizontal holes 1221 in the inner straw 12, and is discharged from the nozzle head 121. Subsequently, the restoration force of the first and second compression springs 125, 126 move the inner straw 122 and the small piston 124 upward such that the small piston 124 closes the holes 1221 in the inner straw 12, thereby preventing spraying-out of the liquid from the nozzle head 121. When the small piston 124 moves upward in the outer straw 123, because the bottom cover 14 is formed with a vent 141, the large piston 13 moves upward in the container body 11 from a position shown in solid lines to that shown in phantom lines, thereby permitting flow of the liquid from the chamber 110 in the container body 11 into the chamber 1232 in the nozzle head unit 12. The aforesaid conventional atomizer 1 suffers from a disadvantage in that there is a need for a relatively high precision during manufacture and assembly of the container body 11 and the large piston 13 in order to achieve an air-tight seal therebetween.

SUMMARY OF THE INVENTION

The object of this invention is to provide an atomizer with a bellows-shaped container body that can prevent undesired entry of air into a liquid-containing chamber in the container body and that can reduce the manufacturing precision requirement.

According to this invention, an atomizer includes a flexible container body and a nozzle head unit. The container body includes a bellows-shaped surrounding wall, a bottom wall having an outer periphery that is formed integrally with a bottom end of the surrounding wall so as to define a closed bottom end of the container body, and a liquid-containing chamber defined within the surrounding wall and above the bottom wall and adapted to be filled with liquid. The nozzle head unit is attached to a top end of the surrounding wall, and can be operated so as to contract the container body, thereby discharging the liquid from the container body via the nozzle head unit. Because air can gain access into the chamber only via the nozzle head unit, undesired entry of air into the chamber can be prevented effectively. As such, there is no need for a high precision during manufacture and assembly of the atomizer.

BRIEF DESCRIPTION OF THE DRAWINGS

These and other features and advantages of this invention will become apparent in the following detailed description of the preferred embodiments of this invention, with reference to the accompanying drawings, in which.

DETAILED DESCRIPTION OF THE PREFERRED EMBODIMENTS

Before the present invention is described in greater detail in connection with the preferred embodiments, it should be noted that similar elements and structures are designated by like reference numbers throughout the entire disclosure.

Figure 1:
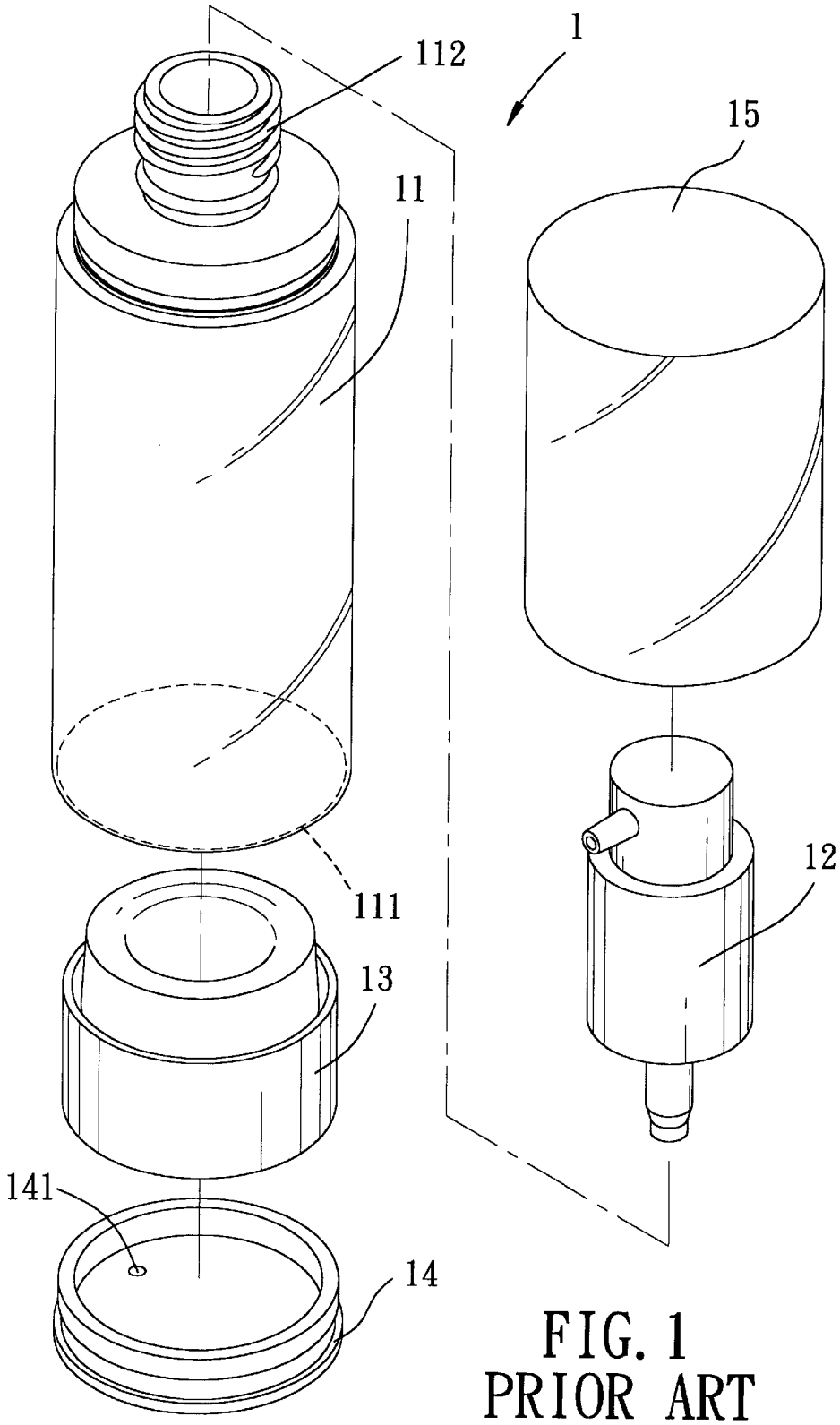
FIG. 1 PRIOR ART
FIG. 1 is an exploded perspective view of a conventional atomizer.
Figure 2:
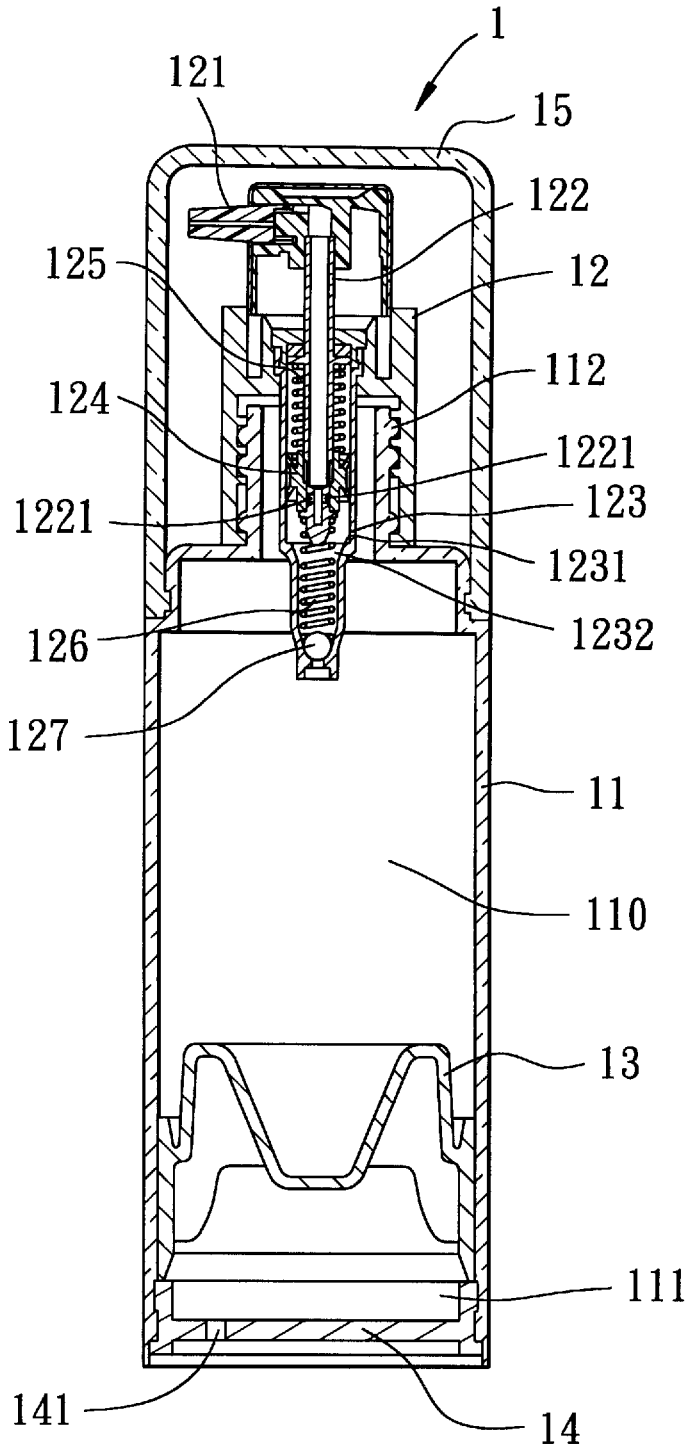
FIG. 2 PRIOR ART
FIG. 2 is a sectional view of the conventional atomizer.
Figure 3:
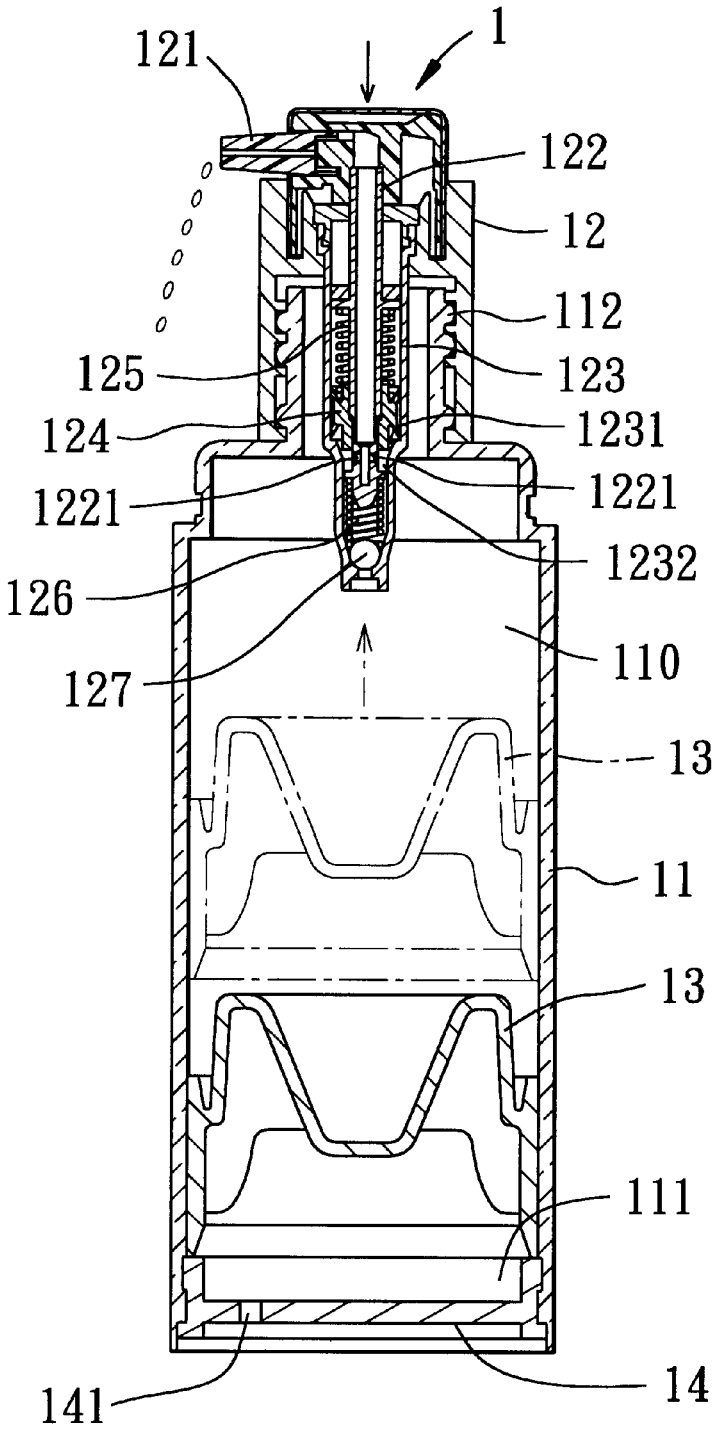
FIG. 3 PRIOR ART
FIG. 3 is a sectional view of the conventional atomizer, illustrating how a liquid is discharged from the atomizer.
Figure 4:
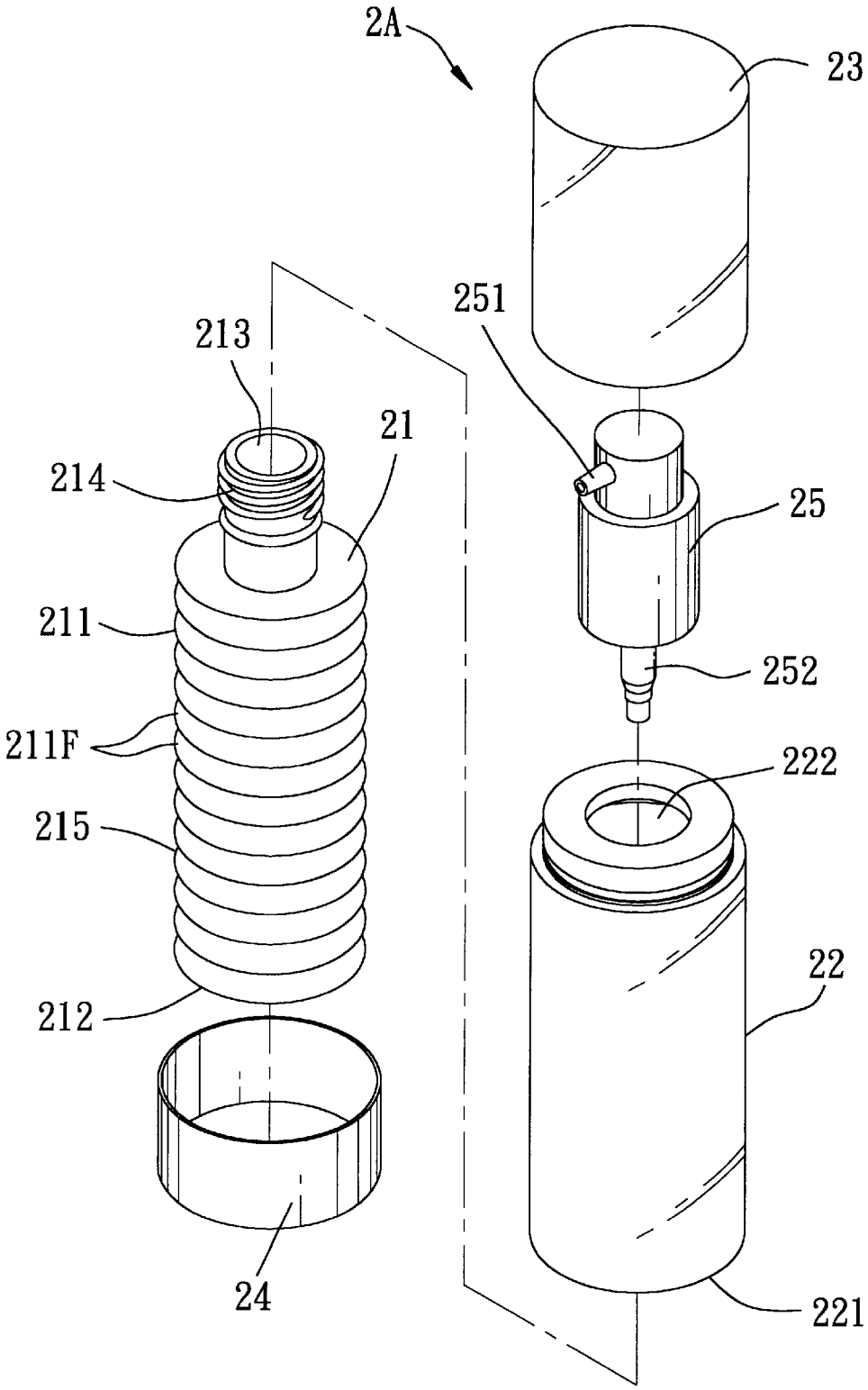
FIG. 4 is an exploded perspective view of a first preferred embodiment of an atomizer according to this invention.
Figure 5:
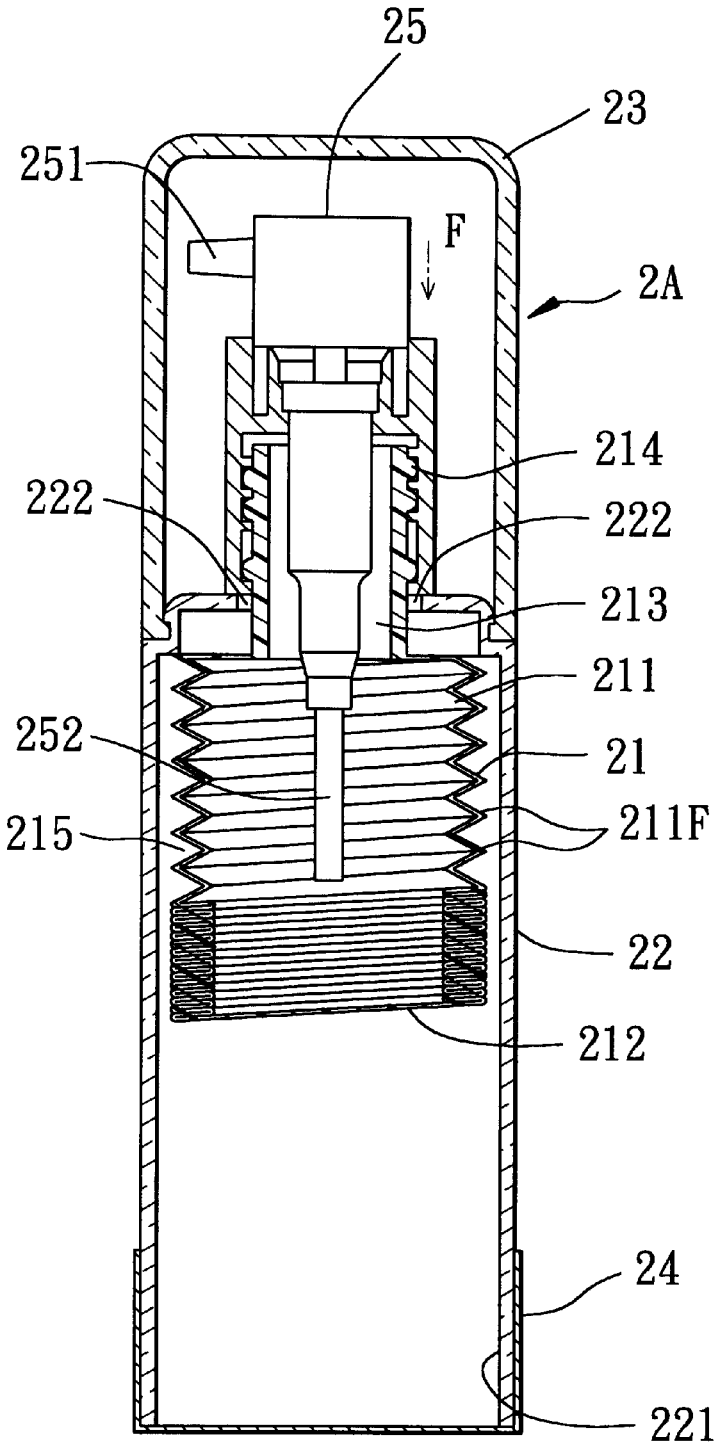
FIG. 5 is a sectional view of the first preferred embodiment.

Referring to FIGS. 4 and 5, a first preferred embodiment of an atomizer (2A) according to this invention is shown to include a flexible container body 21, a housing 22 in the form of a vertical tube, a top cover 23, a bottom cover 24, and a nozzle head unit 25.

The container body 21 is disposed within the housing 22, and includes a bellows-shaped surrounding wall 211 that has a plurality of foldable layers (211F), and a flat bottom wall 212 that is formed integrally with the bottom end of the surrounding wall 211 along an outer periphery thereof so as to define a closed bottom end of the container body 21. The foldable layers (211F) of the surrounding wall 211 cooperatively define both a helical slot 215 in an outer surface of the surrounding wall 211 and a helical slot (not shown) in an inner surface of the surrounding wall 211.

A liquid-containing chamber 213 is defined within the surrounding wall 211 and above the bottom wall 212, and is filled with a liquid, such as perfume. A mounting member 213 is formed integrally with the top end of the surrounding wall 211, and is shaped as an externally threaded neck that engages threadably the nozzle head unit 25 in a known manner.

The housing 22 has an open bottom end 221 that is press-fitted within the bottom cover 24 so as to confine the container body 21 within the housing 22, and a diameter-reduced top end that is formed with a top end opening 222 for extension of the mounting member 214 of the container body 21 therethrough and that is press-fitted within the top cover 23 so as to conceal the nozzle head unit 25 within the top cover 23.

The nozzle head unit 25 is attached to the mounting member 214 of the container body 21, and can be operated to discharge the liquid from the chamber 213 therethrough in such a manner that the foldable layers (211F) are folded from the bottom end of the surrounding wall 211 to the top end of the surrounding wall 211.

The nozzle head unit 25 includes a nozzle head 251 and a vertical straw 252 that is inserted into the chamber 213 in the container body 21. Because the internal structure and operation of the nozzle head unit 25 are not pertinent to the claimed invention, a description thereof will be omitted herein for the sake of brevity.

In use, when the nozzle head 251 is depressed in a direction indicated by an arrowhead (F) in FIG. 5, the liquid is drawn from the chamber 213 into the straw 252 so that the foldable layers (211F) are folded gradually from the bottom end of the surrounding wall 211 to the top end of the surrounding wall 211, as shown in FIG. 5, thereby discharging the liquid from the nozzle head 251. As such, when the foldable layers (211F) are folded, the liquid can flow onto the bottom wall 212 along the helical slot (not shown) in the inner surface of the surrounding wall 211, thereby reducing liquid residue between each adjacent pair of the foldable layers (211F).

Figure 6:
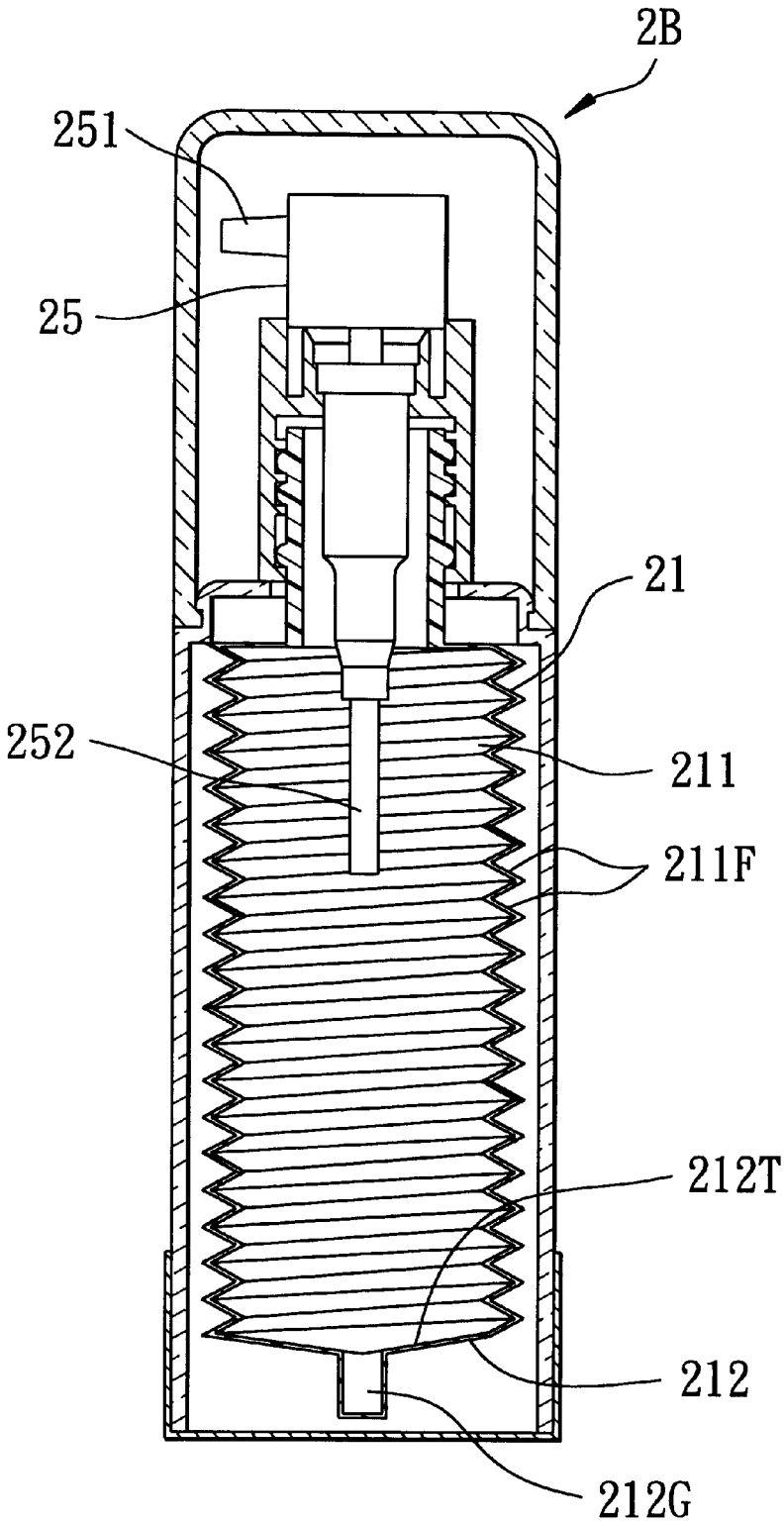
FIG. 6 is a sectional view of a second preferred embodiment of an atomizer according to this invention.
Figure 7:
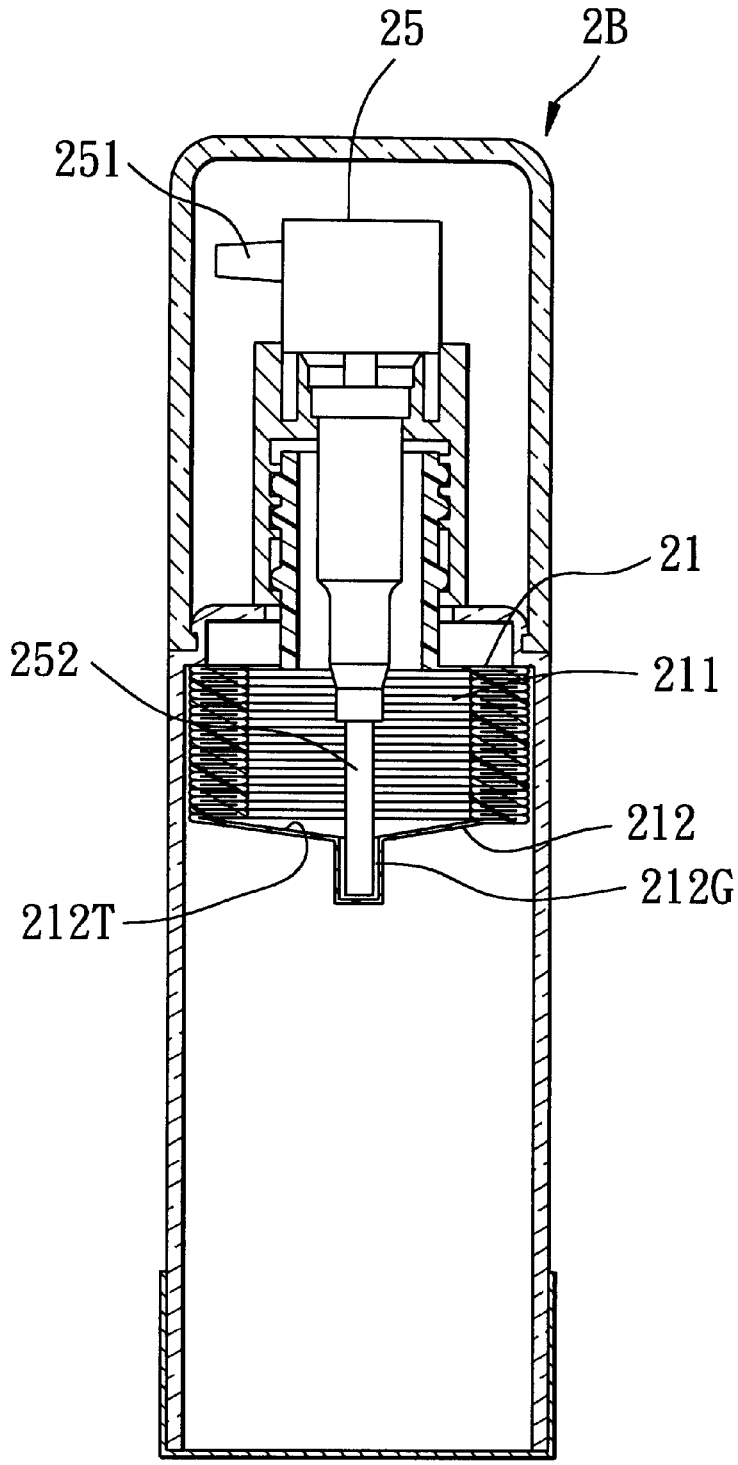
FIG. 7 is a sectional view of the second preferred embodiment, illustrating how a bellows-shaped surrounding wall of a container body contracts completely.

FIGS. 6 and 7 show a second preferred embodiment of an atomizer (2B) according to this invention, which is similar to the first embodiment in construction except that the bottom wall 212 has an outwardly and upwardly inclined top surface (212T) which has a central portion that is formed with a groove (212G). When the foldable layers (311F) are folded, the liquid can flow inward on the inclined top surface (212T) and into the groove (212G). The straw 252 of the nozzle head unit 25 is aligned with the groove (212G) such that a lower end of the straw 252 can move into the groove (212G) when the container body 21 is folded. When the surrounding wall 211 of the container body 21 contracts completely, the lower end of the straw 252 is disposed adjacent to a lower end of the groove (212G), as shown in FIG. 7.

Figure 8:
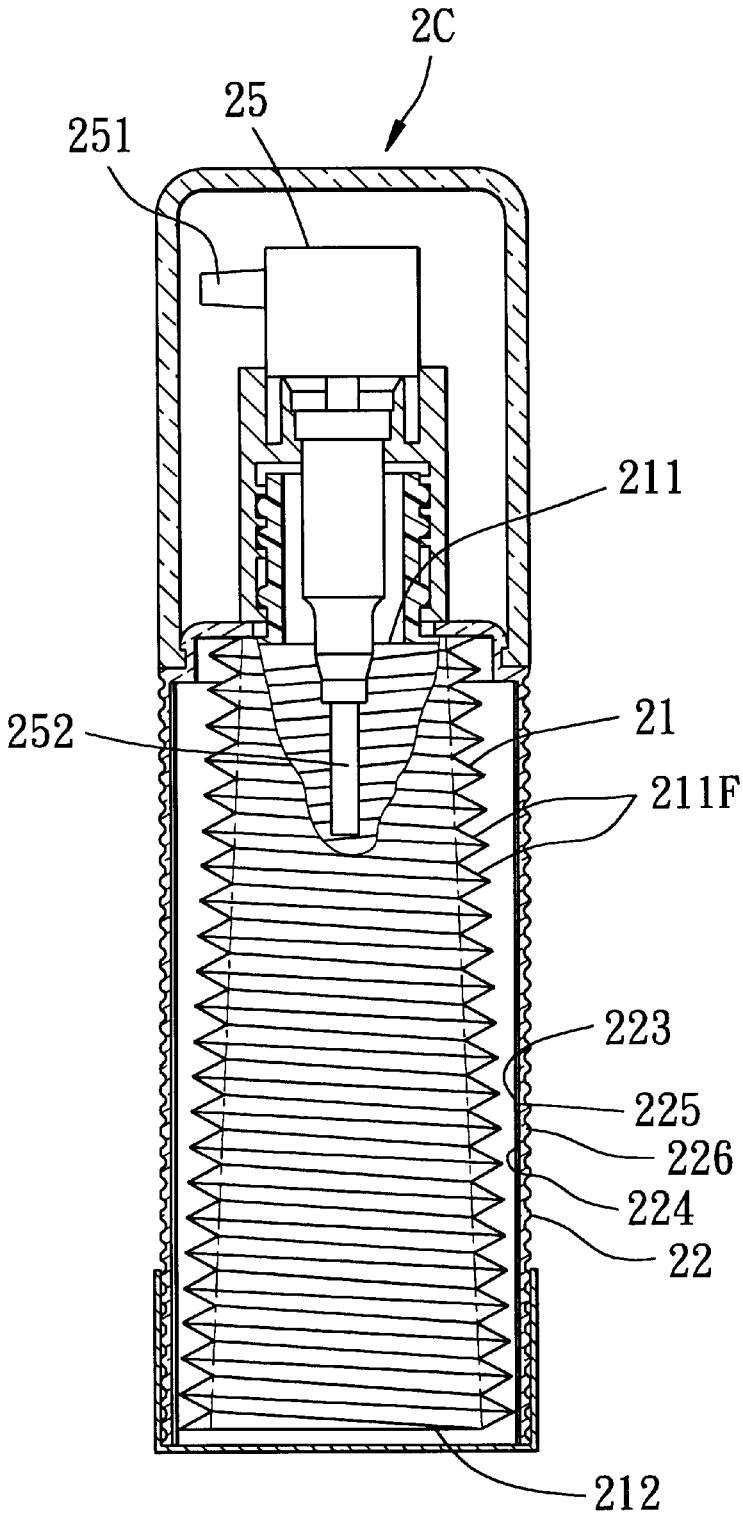
FIG. 8 is a sectional view of a third preferred embodiment of an atomizer according to this invention.

FIG. 8 shows a third preferred embodiment of an atomizer (2C) according to this invention, which is similar to the first embodiment in construction except for the diameter of the surrounding wall 211 and the shape of the housing 22. The foldable layers (211F) have inner and outer diameters that increase downwardly and gradually from the top end of the surrounding wall 211 to the bottom end of the surrounding wall 211, thereby facilitating liquid flow from the surrounding wall 211 onto the bottom wall 212 when the surrounding wall 211 contracts. The housing 22 is made of a transparent material, and has an inner surface 223 that is formed with a plurality of vertical slots 224, and an outer surface 225 that is formed with a rib assembly 226. The rib assembly is constructed as a helical rib that intersects the vertical slots 224 in the inner surface 223 of the housing 22. As such, when light is directed onto the housing 22, the rib assembly 226 and the vertical slots 224 can refract the light, thereby resulting in an aesthetic appearance for the atomizer (2C).

Figure 9:
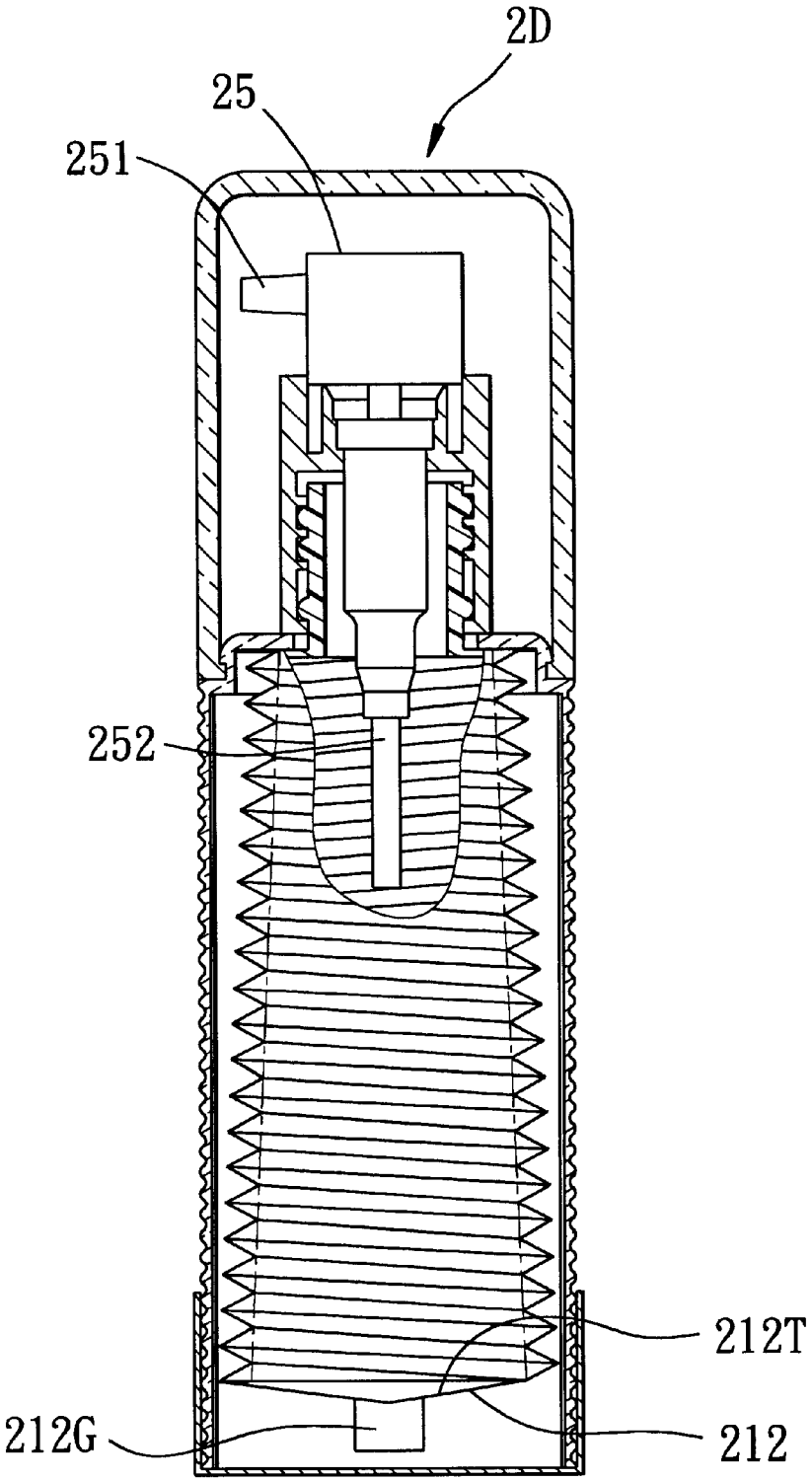
FIG. 9 is a sectional view of a fourth preferred embodiment of an atomizer according to this invention.

FIG. 9 shows a fourth preferred embodiment of an atomizer (2C) according to this invention, which is similar to the third embodiment in construction except that the bottom wall 212 has an outwardly and upwardly inclined top surface (212T) which has a central portion that is formed with a groove (212G).

With this invention thus explained, it is apparent that numerous modifications and variations can be made without departing the scope and spirit of this invention. It is therefore intended that this invention be limited only as indicated by the appended claims.

I claim:

1. An atomizer for containing a liquid, said atomizer comprising:

a flexible container body including a bellows-shaped surrounding wall having a plurality of foldable layers, a top end, and a bottom end, a bottom wall having an outer periphery that is formed integrally with said bottom end of said surrounding wall so as to define a closed bottom end of said container body, a liquid-containing chamber defined within said surrounding wall and above said bottom wall and adapted to be filled with the liquid, and a mounting member disposed on said top end of said surrounding wall; and a nozzle head unit attached to said mounting member of said container body and adapted to be operated to discharge the liquid from said chamber therethrough in such a manner that said foldable layers are folded from said bottom end of said surrounding wall to said top end of said surrounding wall;

wherein said foldable layers of said surrounding wall cooperatively define a helical slot in an outer surface of said surrounding wall, and wherein said bottom wall includes an outwardly and upwardly inclined top surface which has a central portion that is formed with a groove, and which is adapted to guide the liquid to flow inward on said inclined top surface and into said groove, said nozzle head unit including a vertical straw that is disposed within said chamber and that is aligned with said groove such that a lower end of said straw can move into said groove when said surrounding wall contracts, said lower end of said straw being disposed adjacent to a lower end of said groove when said surrounding wall contracts completely.

2. An atomizer for containing a liquid, said atomizer comprising:

a flexible container body including a bellows-shaped surrounding wall having a plurality of foldable layers, a top end, and a bottom end, a bottom wall having an outer periphery that is formed integrally with said bottom end of said surrounding wall so as to define a closed bottom end of said container body, a liquid-containing chamber defined within said surrounding wall and above said bottom wall and adapted to be filled with the liquid, and a mounting member disposed on said top end of said surrounding wall; and a nozzle head unit attached to said mounting member of said container body and adapted to be operated to discharge the liquid from said chamber therethrough in such a manner that said foldable layers are folded from said bottom end of said surrounding wall to said top end of said surrounding wall;

wherein said foldable layers of said surrounding wall cooperatively define a helical slot in an outer surface of said surrounding wall, and wherein said foldable layers have inner and outer diameters that increase downwardly and gradually from said top end of said surrounding wall to said bottom end of said surrounding wall.

3. The atomizer as claimed in claim 2, wherein said bottom wall includes an outwardly and upwardly inclined top surface which has a central portion that is formed with a groove, and which is adapted to guide the liquid to flow inward on said inclined top surface and into said groove, said nozzle head unit including a vertical straw that is disposed within said chamber and that is aligned with said groove such that a lower end of said straw can move into said groove when said surrounding wall contracts, said lower end of said straw being disposed adjacent to a lower end of said groove when said surrounding wall contracts completely.

4. An atomizer for containing a liquid, said atomizer comprising:

a flexible container body including a bellows-shaped surrounding wall having a plurality of foldable layers, a top end, and a bottom end, a bottom wall having an outer periphery that is formed integrally with said bottom end of said surrounding wall so as to define a closed bottom end of said container body, a liquid-containing chamber defined within said surrounding wall and above said bottom wall and adapted to be filled with the liquid, and a mounting member disposed on said top end of said surrounding wall; and a nozzle head unit attached to said mounting member of said container body and adapted to be operated to discharge the liquid from said chamber therethrough in such a manner that said foldable layers are folded from said bottom end of said surrounding wall to said top end of said surrounding wall;

wherein said foldable layers of said surrounding wall cooperatively define a helical slot in an outer surface of said surrounding wall, and wherein said mounting member is constructed as an externally threaded neck that is formed integrally with said top end of said surrounding wall and that engages threadably said nozzle head unit, said atomizer further including:

a housing, within which said container body is disposed, said housing being shaped as a vertical tube, which has an open bottom end and a top end opening, through which said mounting member extends; and a bottom cover sleeved fixedly on said bottom end of said housing so as to confine said container body with said housing.

5. The atomizer as claimed in claim 4, wherein said housing is made of a transparent material, and has an inner surface that is formed with a plurality of vertical slots, and an outer surface that is formed with a rib assembly, said rib assembly intersecting said vertical slots in said inner surface of said housing, whereby, when light is directed onto said housing, said rib assembly and said vertical slots can refract the light.

6. The atomizer as claimed in claim 5, wherein said rib assembly is constructed as a helical rib.

* * * * *